US008130991B2

(12) United States Patent
Rasmussen et al.

(10) Patent No.: US 8,130,991 B2
(45) Date of Patent: Mar. 6, 2012

(54) HEARING INSTRUMENT WITH LINEARIZED OUTPUT STAGE

(75) Inventors: Karsten Bo Rasmussen, Smørum (DK); Steen Michael Munk, Smørum (DK)

(73) Assignee: Oticon A/S, Smorum (DK)

( * ) Notice: Subject to any disclaimer, the term of this patent is extended or adjusted under 35 U.S.C. 154(b) by 1000 days.

(21) Appl. No.: 12/081,125

(22) Filed: Apr. 10, 2008

(65) Prior Publication Data

US 2008/0253594 A1 Oct. 16, 2008

(30) Foreign Application Priority Data

Apr. 11, 2007 (EP) ..... 07105978

(51) Int. Cl.
*H04R 25/00* (2006.01)

(52) U.S. Cl. ..... 381/317; 381/318; 381/71.6; 381/71.11

(58) Field of Classification Search ..... 381/317, 381/318, 71.6, 71.11
See application file for complete search history.

(56) References Cited

U.S. PATENT DOCUMENTS

| | | | | |
|---|---|---|---|---|
| 5,448,644 | A | 9/1995 | Pfannenmueller et al. | |
| 6,658,122 | B1 * | 12/2003 | Westermann et al. | 381/312 |
| 6,785,394 | B1 * | 8/2004 | Olsen et al. | 381/312 |

FOREIGN PATENT DOCUMENTS

| | | | |
|---|---|---|---|
| WO | WO-00/28784 | | 5/2000 |
| WO | WO-01/06812 | A1 | 1/2001 |
| WO | WO-2004/021740 | A1 | 3/2004 |

* cited by examiner

*Primary Examiner* — Tu-Tu Ho
(74) *Attorney, Agent, or Firm* — Birch, Stewart, Kolasch & Birch, LLP

(57) ABSTRACT

This invention relates to a hearing instrument (100), which comprises a first microphone (102) converting ambient sound to an ambient sound signal, a signal processor (104) generating a processed sound signal based on the ambient sound signal, a controllable output stage (106) generating a driving signal based on the processed sound signal and in accordance with a control signal, a speaker unit (110) generating a sound in the ear canal based on said driving signal, a second microphone (116) located in the ear canal of the user and converting the sound in the ear canal to the monitor sound signal, and a linearization stage (108) comparing the processed sound signal and the monitor sound signal and generating the control signal based thereon.

11 Claims, 1 Drawing Sheet

HEARING INSTRUMENT WITH LINEARIZED OUTPUT STAGE

FIELD OF THE INVENTION

This invention relates to a hearing instrument, particularly to a hearing instrument having an output section, which is adapted to linearize a speaker of the hearing instrument. In this context a hearing instrument may be hearing aids such as in-the-ear (ITE), completely-in-canal (CIC), behind-the-ear (BTE), or receiver-in-the-ear (RITE) hearing aids, as well as headphones, headsets or earphones.

BACKGROUND OF THE INVENTION

A speaker is an electro-mechanical transducer that reproduces an electrical signal as an acoustical signal. However, speakers are generally non-linear devices and consequently they introduce distortion when an electrical signal is to be reproduced.

U.S. Pat. No. 6,173,063 discloses a hearing instrument with a feedback configuration and a voltage regulator. The voltage regulator is provided to regulate voltage supplied by a battery supply to a class D output of the hearing instrument. In order to compensate for the undesired acoustical coupling from the speaker to the microphone of the hearing instrument, a feedback loop to cancel the effect of the undesired acoustical coupling is disclosed. The feedback loop extends from the output of a hearing instrument processor to the input of the hearing instrument processor.

US 2006/0188089 discloses methods and systems for echo cancellation in a speakerphone appliance connected to a telephone network. The speakerphone appliance has a station with a microphone and a loudspeaker, in addition to a handset with a loudspeaker and a microphone. A circuit is configured to measure the acoustical output from the loudspeaker of the station by means of the handset microphone. The measurement is used in a feedback system to reduce echo effects caused by the microphone and loudspeaker of the speakerphone appliance and reproduced in the acoustical output of the loudspeaker.

WO 96/26624 discloses audio system for a telephone with an adaptive pre-compensation filter for the correction of distortion in a loudspeaker. The pre-compensating filter models a non-linear speaker and receives an input signal representing a desired acoustic signal and provides an output signal for a loudspeaker via a loudspeaker drive unit. The pre-compensating filter is adaptively controlled via a filter modifier receiving the input signal and a signal from a microphone, which is adapted to pick up the acoustic signal produced by the loudspeaker. The pre-compensation filter is adaptively controlled so as to compensate for distortion produced by the loudspeaker.

However, the disclosed pre-compensation filter is not practical as a solution for a hearing instrument, since pre-compensation implies some insight in the actual non-linearity of a specific speaker. In the case of hearing instruments non-linearity may vary considerably from speaker to speaker in-situ in the ear canal of a hearing instrument user.

SUMMARY OF THE INVENTION

An object of the present invention is therefore to provide a hearing instrument overcoming the problems introduced by non-linearity of a speaker.

A particular advantage of the present invention relates to the fact that the hearing instrument increases sound quality by adaptively reducing distortion caused by a speaker in-situ e.g. in the ear canal of the user.

The above object and advantage together with numerous other objects, advantages and features, which will become evident from below detailed description, are obtained according to a first aspect of the present invention by a hearing instrument comprising a first microphone adapted to convert ambient sound to an ambient sound signal, a signal processor adapted to generate a processed sound signal based on said ambient sound signal, a controllable output stage adapted to generate a driving signal based on said processed sound signal and in accordance with a control signal, a speaker unit adapted to generate a sound in the ear canal based on said driving signal, a second microphone located in the ear canal of the user and adapted to convert said sound in the ear canal to said monitor sound signal, and a linearization stage adapted to compare said processed sound signal and said monitor sound signal and to generate said control signal based thereon.

The term "linearize", "linearizing" or "linearization" is in this context to be construed as the attempting to establish a linear effect of a non-linear component.

Further, the term "processed" is in this context to be construed as conformed in accordance with a set of rules, which in this particular usage involves establishing a transfer function of the hearing instrument for a particular user, which may compensate for that user's hearing impairment.

Further, the term "ambient sound" is in this context to be construed as sound in the surroundings of the user i.e. sound which occurs or is present in the environment of the user of the hearing instrument. On the other hand, the term "monitor sound" is in this context to be construed as the sound, which is presented by the speaker of the hearing instrument to the user in the residual space between the tympanic member and the speaker unit. The second microphone thus measures the actual sound presented to the user, when the user is exposed to an ambient sound.

Finally, the term "controllable" is in this context to be construed as operable to perform certain actions based on instructions received.

The hearing instrument according to the first aspect of the present invention may effectively adjust the driving signal of the output stage so as to linearize the speaker unit as well as the output stage of the hearing instrument. The linearization of the output stage and speaker unit causes a reduction of distortion, which enables an improved sound quality experienced by the user of the hearing instrument.

Distortion may generally be reduced by proper design of a speaker by providing a speaker with better linearity. However, such improvement in linearity affects efficiency in terms of electrical to acoustical conversion of the speaker. Thus, conventionally the electro-mechanical configurations of speakers for hearing instruments are designed according to a compromise where efficiency is traded for linearity—or vice versa.

The hearing instrument according to the first aspect of the present invention may be implemented as an analogue or digital system. Obviously, digital hearing instruments today are advantageous due to the simple programmable features of digital signal processing means. Nevertheless, the hearing instrument according to the first aspect of the present invention may be implemented as an analogue system wherein non-linearity of the speaker unit is reduced.

The controllable output stage according to the first aspect of the present invention may comprise a pulse modulating unit adapted to receive said processed sound signal and generate a pulse train signal based thereon. The output stage may further comprise a converting unit adapted to convert said pulse train signal to said driving signal. Further, the pulse modulating unit may comprise a pulse modulating unit comprises a pulse-code modulation element such as a pulse-width modulation, a pulse-density modulation, a pulse-phase modulation, and/or a pulse-amplitude modulation element. Thus the output stage may, advantageously, operate as a discrete level power output stage, such as class D, which provides a high conversion efficiency and utilization of power.

The speaker unit according to the first aspect of the present invention may comprise piezoelectric speaker and/or magnetic speaker. The speaker unit may utilize any technology known to the skilled person, as long the speaker unit has a size which is adaptable for insertion into the ear canal of a user.

The linearization stage according to the first aspect of the present invention may comprise a delay stage adapted to delay said processed sound signal by a time delay. The time delay, advantageously, may have a size comparable to the time delay of said output stage, speaker unit and second microphone. The linearization stage further may comprise a comparator adapted to generate said control signal based on a comparison between said monitor sound signal and said delayed processed sound signal. The comparator thus performs a comparison between the desired signal instrument and the factual signal provided to the user of the hearing instrument. A delay may be required in order to perform the necessary comparison of the signals due to the fact that processed sound signal is delayed through the output stage, speaker unit and coupling back to and through the second microphone.

The delay stage according to the first aspect of the present invention may comprise a shift register adapted to shift digital frames of the processed sound signal so as to obtain a particular digital delay.

The linearization stage according to the first aspect of the present invention may further comprise an analogue to digital converter (A/D) adapted to convert said monitor sound signal into a digital form. By introducing the A/D converter the linearization operation advantageously may become digital, which provides an ideal situation for operating this linearization compensation within the digital domain.

The comparator according to the first aspect of the present invention may comprise a control processor adapted to determine deviation between said delayed processed sound signal and said monitor sound signal and based thereon generate said control signal adapted to compensate for said deviation. The control processor may advantageously be implemented as a part of the general chip-design for the hearing instrument and possibly together with the design of the signal processor.

The hearing instrument according to the first aspect of the present invention may further comprise an earpiece adapted for insertion in the ear canal of the user and wherein the speaker unit and the second microphone may be situated. The hearing instrument may thus advantageously be implemented as an ITE, CIC or a BTE type hearing aid.

Obviously, the first microphone according to the first aspect of the present invention may comprise a microphone array and/or one or more directional microphones. The hearing instrument as such may advantageously incorporate a wide variety of functionalities for reducing noise and enhancing intelligibility.

When the pulse modulator comprises a pulse generating modulator which may be controllable in response to a signal received from the second microphone, the pulse modulator can be implemented to provide high precision, by means of simple components.

BRIEF DESCRIPTION OF THE DRAWINGS

The above and/or additional objects, features and advantages of the present invention, will be further elucidated by the following illustrative and non-limiting detailed description of embodiments of the present invention, with reference to the appended drawings, wherein.

DETAILED DESCRIPTION

In the following description, reference is made to the accompanying figures, which, by way of illustration, show how the invention may be practiced.

Figure 1:
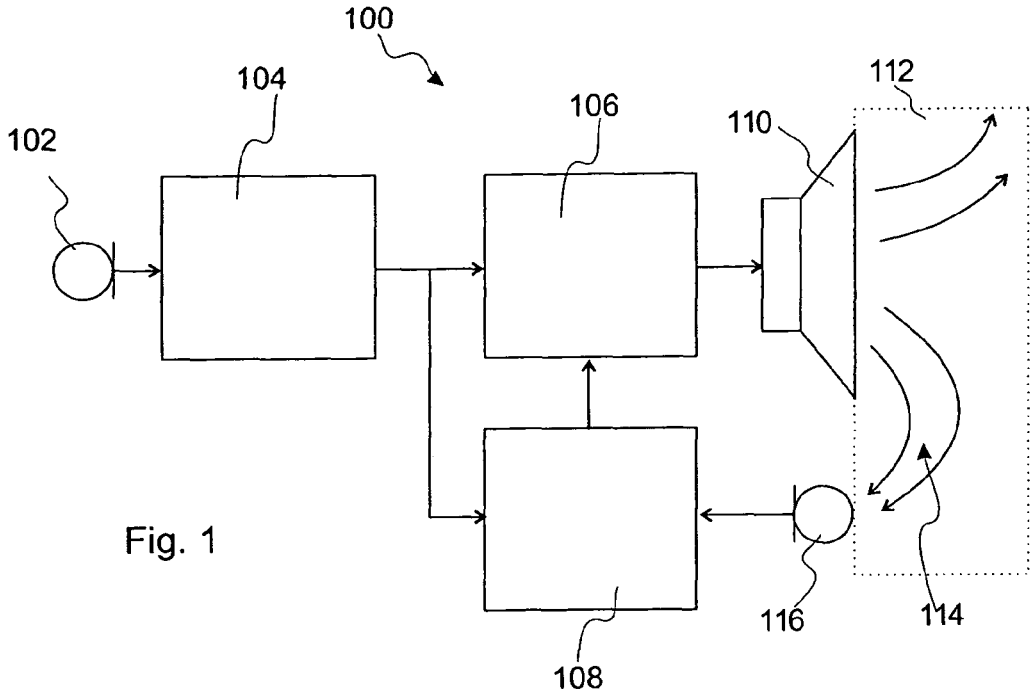
FIG. 1 shows a hearing instrument according to a first embodiment of the present invention.

FIG. 1 shows a hearing instrument designated in entirety by reference numeral 100. The hearing instrument comprises a first microphone unit 102 for converting ambient sound to an electric sound signal and connected to a signal processor 104. The signal processor 104 performs signal processing of the sound signal, which processing generally is in accordance with a recorded transfer function compensating for a hearing impairment. The signal processor 104 may as described with reference to FIG. 2 comprise further elements for performing various tasks.

It should be noted that the signal processor 104 may comprise a plurality of elements for managing a wide variety of actions, which elements are known to the skilled person and may be found in patent applications such as European patent application no.: EP 1 708 543.

The signal processor 104 generates a processed sound signal, which is communicated to an output stage 106 and a linearization stage 108. The output stage 106 converts the processed sound signal to driving signal for a speaker unit 110, which is placed in the ear canal of the user. Since the processed sound signal generally is in the digital domain the output stage 108 comprises means for converting the digital processed signal into an analogous driving signal for the speaker unit 110. The output stage 108 may be configured in a wide variety of implementation in accordance with type of processed signal as well as other electric design considerations such as efficiency and power consumption.

The speaker unit 110 converts the driving signal from the output stage 106 to a processed sound in the ear canal of the user of the hearing instrument 100. The speaker unit 110 may be incorporated in an ear-piece to be used in connection with a BTE hearing aid such as a RITE, in the form of an earplug or open dome type ear piece, or the speaker unit 110 may an integral part of an ITE or CIC type hearing aid.

The speaker unit 110 provides the processed sound to the residual space 112 defined between the speaker unit 110, the ear canal walls and the tympanic membrane. As described above the residual space 112 may be in open connection with the ambient so as to allow ambient sound to the tympanic membrane as well as to avoid occlusion effect generally experienced in closed systems such as non-vented earplugs or ITE or CIC hearing instruments.

Some of the processed sound, illustrated by arrows 114, is communicated to a monitor microphone 116 converting the processed sound into an electric monitor sound signal. The monitor sound signal is communicated to the linearization stage 108, which utilizes information from the processed sound signal and from the monitor sound signal for generating a control signal to the output stage 106.

The monitor sound signal may be influenced by the ambient sound as well as reflective contributions from the residual space. However, this contribution is relative to the processed sound generated by the speaker unit 110 rather small, and therefore of minor importance. Nevertheless, the linearization stage 108 may in one embodiment of the present invention comprise a level detector for activating the linearization stage 108 at a particular level of the processed signal. Further, the signal processor 104 may in the one embodiment comprise a voice identification element capable of identifying own voice of the user of the hearing instrument and generate a flag signal to the linearization stage 108 in case own voice is detected and thereby disabling the linearization.

Figure 2:
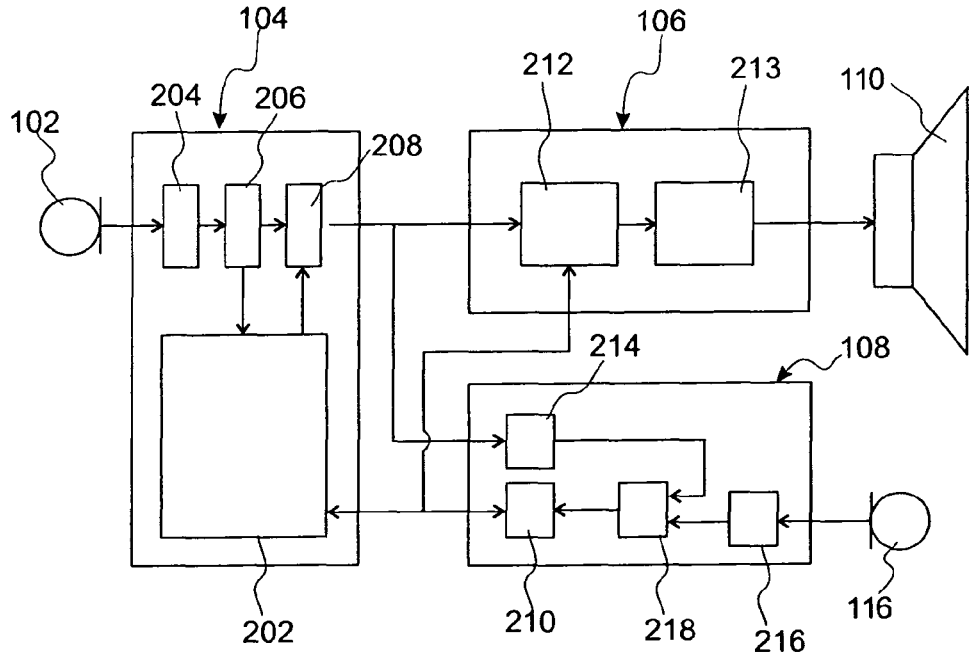
FIG. 2 shows the hearing instrument according to the first embodiment in further detail.

FIG. 2 shows the signal processor 104, the output stage 106 and the linearization stage 108 in further detail. The signal processor 104 comprises a processor element 202 controlling transfer function of the hearing instrument. That is, the processor element 202 determines based on various inputs which transfer function is appropriate for the user. For example, the user may be in a noisy sound environment necessitating a higher directionality of the first microphone unit 102, which may be accomplished by the first microphone unit 102 comprising a set of microphones combining signals.

The signal processor 104 further comprises a first analogue to digital converter 204 for converting the analogous sound signal into a digital format. The increased directionality may be accomplished by digitally combining the signal from the set of microphones, and therefore the signal processor 104 in one embodiment may comprise an analogue to digital converter for each microphone signal.

The digital sound signal may be communicated to an own-voice detector 206, which establishes whether the digital sound signal includes own-voice of the user of the hearing instrument 100. The own-voice detector 206 generates a flag signal to the processor element 202, which flag signal the processor element 202 may communicate to the linearization stage 108, namely a controlling element 210 in the linearization stage 108.

The processor element 202 further controls a signal processing element 208 adapted to amplify and/or filter the sound signal in accordance with sound environment as well as hearing impairment of the user. In one embodiment of the signal processor 104 the signal processing element 208 is implemented as a FIR filter.

The processed sound signal is communicated to a pulse modulation element 212 in the output stage 106, which transforms the digital processed sound signal to a discrete level signal, such as achieved by a delta-sigma pulse width modulator. The output stage 104 further comprises a driver element 213 for providing a driving signal for the speaker unit 110. In one embodiment of the present invention the driver element 213 provides a gain to the processed sound signal.

The processed sound signal is further communicated to delay element 214 in the linearization stage 108, which delay element 214 delays the processed sound signal with a time delay substantially matching the delay experienced through the output stage 106, the speaker unit 110, the residual space 112, the monitor microphone 116 and a second analogue to digital converter 216. Hence the delay element 214 ensures that the signals compared by a comparator element 218, namely the processed sound signal and the monitor sound signal, describe the ambient sound at the same moment in time. The delay element 214 may advantageously be implemented as a shift register. The shift register may have a variable length so as enable to adjust delay in accordance with the actual residual space for the user of the hearing instrument as well as in accordance with variations of component tolerances.

The invention claimed is:

1. A hearing instrument, comprising:

a first microphone adapted to convert ambient sound to an ambient sound signal;

a signal processor adapted to generate a processed sound signal based on said ambient sound signal;

a controllable output stage adapted to generate a driving signal based on said processed sound signal and in accordance with a control signal;

a speaker unit adapted to generate a sound in the ear canal based on said driving signal;

a second microphone located in the ear canal of the user and adapted to convert said sound in the ear canal to said monitor sound signal; and a linearazation stage adapted to compare said processed sound signal and said monitor sound signal and to generate said control signal based thereon, the linearization stage including a delay stage adapted to delay said processed sound signal by the time delay, and the delay stage including a shift register adapted to shift digital frames of the processed sound signal to as to obtain a particular digital delay.

2. A hearing instrument according to claim 1, wherein said controllable output stage comprises a pulse modulating unit adapted to receive said processed sound signal and generate a pulse train signal based thereon.

3. A hearing instrument according to claim 2, wherein said output stage further comprises a converting unit adapted to convert said pulse train signal to said driving signal.

4. A hearing instrument according to claim 2, wherein said pulse modulating unit comprises a pulse-code modulation element such as a pulse-width modulation, a pulse-density modulation, a pulse-phase modulation, and/or a pulse-amplitude modulation element.

5. A hearing instrument according to claim 1, wherein said speaker unit comprises piezoelectric speaker and/or magnetic speaker.

6. A hearing instrument according to claim 1, wherein said linearization stage further comprises a comparator adapted to generate said control signal based on a comparison between said monitor sound signal and said delayed processed sound signal.

7. A hearing instrument according to claim 1, wherein said linearization stage further comprises an analogue to digital converter (A/D) adapted to convert said monitor sound signal into a digital form.

8. A hearing instrument according to claim 6, wherein said comparator comprises a control processor adapted to determine deviation between said delayed processed sound signal and said monitor sound signal and based thereon generate said control signal adapted to compensate for said deviation.

9. A hearing instrument according to claim 8, wherein said control processor is implemented integral with said signal processor.

10. A hearing instrument according to claim 1 further comprising an earpiece adapted for insertion in the ear canal of the user and wherein said speaker unit and said second microphone is situated.

11. A hearing instrument according to claim 1, wherein said first microphone comprises a microphone array and/or one or more directional microphones.

* * * * *